US007678297B2

(12) United States Patent
Inaba et al.

(10) Patent No.: US 7,678,297 B2
(45) Date of Patent: Mar. 16, 2010

(54) TRANSPARENT CONDUCTIVE MATERIAL AND TRANSPARENT CONDUCTOR

(75) Inventors: Kazuhisa Inaba, Tokyo (JP); Noriyuki Yasuda, Tokyo (JP)

(73) Assignee: TDK Corporation, Tokyo (JP)

( * ) Notice: Subject to any disclaimer, the term of this patent is extended or adjusted under 35 U.S.C. 154(b) by 0 days.

(21) Appl. No.: 12/275,642

(22) Filed: Nov. 21, 2008

(65) Prior Publication Data

US 2009/0140218 A1 Jun. 4, 2009

(30) Foreign Application Priority Data

Nov. 30, 2007 (JP) ..... 2007-311448

(51) Int. Cl.
*H01B 1/20* (2006.01)

(52) U.S. Cl. ..... 252/521.3; 252/519.31

(58) Field of Classification Search ..... 252/521.3, 252/519.31, 518.1, 519.1, 519.12, 520.1, 252/520.21; 428/702, 411.1, 447
See application file for complete search history.

(56) References Cited

U.S. PATENT DOCUMENTS

| | | | | |
|---|---|---|---|---|
| 5,013,607 | A * | 5/1991 | Sato et al. | 428/426 |
| 6,086,790 | A * | 7/2000 | Hayashi et al. | 252/500 |
| 6,362,414 | B1 * | 3/2002 | Fujisawa et al. | 136/256 |
| 6,444,898 | B1 * | 9/2002 | Fujisawa et al. | 136/256 |
| 6,744,425 | B2 * | 6/2004 | Yoshikawa et al. | 345/173 |
| 6,808,654 | B2 * | 10/2004 | Hayashi et al. | 252/512 |
| 6,881,357 | B2 * | 4/2005 | Lee et al. | 252/511 |
| 6,987,354 | B2 * | 1/2006 | Arakawa et al. | 313/506 |
| 7,153,544 | B2 * | 12/2006 | Yoshikawa et al. | 427/255.18 |
| 7,323,122 | B2 * | 1/2008 | Muraguchi et al. | 252/521.3 |
| 7,371,452 | B2 * | 5/2008 | Bourdelais et al. | 428/188 |
| 7,488,894 | B2 * | 2/2009 | Iijima | 174/117 A |
| 7,576,142 | B2 * | 8/2009 | Tauchi et al. | 522/168 |
| 2003/0168644 | A1 * | 9/2003 | Lee et al. | 252/518.1 |
| 2006/0134431 | A1 * | 6/2006 | Yasuda et al. | 428/411.1 |
| 2006/0222855 | A1 * | 10/2006 | Yasuda | 428/411.1 |
| 2008/0024055 | A1 * | 1/2008 | Marks et al. | 313/504 |
| 2008/0152870 | A1 * | 6/2008 | Takada et al. | 428/174 |
| 2008/0152926 | A1 * | 6/2008 | Baikerikar et al. | 428/422.8 |

FOREIGN PATENT DOCUMENTS

| | | |
|---|---|---|
| JP | A-2006-059722 | 3/2006 |
| JP | A-2006-092869 | 4/2006 |
| JP | A-2006-185865 | 7/2006 |

* cited by examiner

*Primary Examiner*—Douglas Mc Ginty
(74) *Attorney, Agent, or Firm*—Oliff & Berridge, PLC

(57) ABSTRACT

The present invention provides a transparent conductive material with little change in electric resistance under influence of temperature or humidity and a transparent conductive membrane using the same. The transparent conductive material of the present invention includes a resin, a transparent conductive particle, a silica material containing at least either of a silica particle or a precursor of silica particle, and a silane coupling agent.

3 Claims, 2 Drawing Sheets

TRANSPARENT CONDUCTIVE MATERIAL AND TRANSPARENT CONDUCTOR

BACKGROUND OF THE INVENTION

1. Field of the Invention

The present invention relates to a transparent conductive material and a transparent conductor using the same.

2. Related Background Art

A transparent electrode is used for a display device, such as an LCD, a PDP, an organic EL and a touch panel. The transparent electrode is often constituted of a transparent conductive material such as indium tin oxide (hereinafter abbreviated as "ITO"). An ITO electrode formed by sputtering deposition has been used as the transparent electrode. Meanwhile, a coating method to prepare an ITO electrode has also drawn attention, because it can impart a property such as high flexibility not attainable by an ITO electrode obtained by a sputtering method. However, conventional transparent ITO electrodes obtained by the coating method has tendency that, when placed in a high temperature and/or high humidity environment, the electric resistance is increased by oxygen or moisture in the atmosphere, which is a cause of reduced reliability.

In this regard, the present inventors have disclosed a transparent conductive material including a transparent conductive particle and a curable compound (Japanese Patent Laid-Open Nos. 2006-059722, 2006-092869 and 2006-185865), in order to provide a transparent conductor (transparent conductive material) exhibiting little change in electric resistance in a high temperature and/or high humidity environment (hereinafter referred to as "under high temperature and humidity").

With the aforementioned transparent conductive material, an increase in electric resistance due to influence of moisture under high temperature and humidity can be adequately suppressed. However, due to recent expanding applications of a transparent electrode, usability under severer conditions than before (e.g. under an environment of 60° C. and 95% RH or 85° C. and 85% RH) has been demanded. A transparent conductive material has therefore been requested, which can suppress an increase in resistance value under high temperature and humidity more strongly than before.

The present invention has been made under such circumstances, with an object to provide a transparent conductive material with little change in resistance value under influence of temperature or humidity, and a transparent conductive membrane using the same.

SUMMARY OF THE INVENTION

To realize the above object, a transparent conductive material of the present invention comprises a resin; a transparent conductive particle; a silica material comprising at least either of a silica particle or a precursor of a silica particle; and a silane coupling agent. A "precursor of a silica particle" used herein means a material convertible to a silica particle.

Since the transparent conductive material of the present invention includes, in addition to a transparent conductive particle as a conductive component and a resin as a binder binding the same, a silica material and a silane coupling agent, an increase of resistance value under high temperature and humidity can be remarkably suppressed, when the material is formed into a transparent electrode.

Although the causes of the phenomenon have not been fully clarified, they are presumed as follows. A transparent conductive membrane is usually composed of a certain transparent substrate and a transparent conductive layer that is made of a cured transparent conductive material and laminated on the substrate. It is considered that, with a conventional transparent conductive membrane having such a composition, since a resin and a substrate expand under high temperature and humidity by heating or absorption of the humidity, the transparent conductive membrane is also stretched to increase the resistance value. Furthermore, since the surface activity of the transparent conductive particle tends to increase with micronization of the particle, and a decrease of oxygen vacancies, namely an increase of the resistance value can occur to no small extent in the temperature range where normally the influence is negligible, the oxygen content and oxygen permeability of the transparent conductive membrane are considered to have also influence on the phenomenon.

In contrast, since the transparent conductive material of the present invention contains, in addition to a transparent conductive particle and a resin, a silica material and a silane coupling agent, when the transparent conductive layer is formed by curing the same, the strength of the layer itself can be enhanced by the silica particle, and furthermore, with the silane coupling agent, the transparent conductive particle and the cured resin form a tightly bound state with nuclei of the silica particle. Presumably owing to them, the stretching of the transparent conductive layer is suppressed and the oxygen permeability is decreased. It is believed that the silane coupling agent bonds to or compatibilizes with the resin, and forms a covalent bond or a hydrogen bond or both with the silica particle and the transparent conductive particle, so that the silica particle and the transparent conductive particle can be bonded with the resin. Its action is, however, not necessarily limited thereto.

In case a transparent conductive membrane is formed with the transparent conductive material of the present invention, even if the expansion of the substrate occurs under high temperature and humidity, the stretching of the transparent conductive layer becomes difficult and the oxygen permeability is suppressed compared with a conventional product, so that the increase of the resistance value of the transparent conductive layer by heat and humidity can be suppressed substantially and as a result a property of low resistance value change can be maintained under high temperature and humidity.

The content of the silica material in the transparent conductive material of the present invention is preferably 0.1 to 40% by mass relative to the total quantity of the transparent conductive particle and the silica material. With such a content, the percentage of the silica particle can be optimized in the transparent conductive membrane, so that the resistance value change under high temperature and humidity can be suppressed, while maintaining the resistance value itself of the transparent conductive membrane sufficiently low.

The present invention provides also a transparent conductor having a transparent conductive layer comprising a cured body of the transparent conductive material of the present invention. Since such a transparent conductor is provided with a transparent conductive layer composed of the transparent conductive material of the present invention, it does not stretch remarkably under high temperature and humidity as described above, the resistance value increase over time occurs hardly.

The transparent conductor of the present invention can have, for example, a membrane form composed of a substrate with the transparent conductive layer thereon. In this case, substrates composed of one or more of the following various materials, such as glass, inorganic compounds and organic compounds can be used. The transparent conductor of the present invention is preferably provided, among others, with a substrate containing an organic compound and the transparent conductive layer formed on the substrate. Since the substrate composed of a plastic material is thin and flexible, a transparent conductor having the substrate can be also thin and flexible, which is expected to be applicable to various uses. On the other hand, since a flexible substrate with a plastic material is easy to expand by heat or humidity, the resistance of a transparent conductor with such a substrate conventionally tends to increase easily under high temperature and humidity. In contrast, the transparent conductor of the present invention is provided with a transparent conductive layer that is resistant to stretch under high temperature and humidity as described above, and the resistance increase hardly occurs, even if the substrate expands. Therefore the conductor is especially suitable, when such a substrate containing an organic compound is used.

The present invention can provide a transparent conductive material with little resistance value change under the influence of heat or humidity, and a transparent conductor utilizing the same.

DESCRIPTION OF THE PREFERRED EMBODIMENTS

Figure 1:
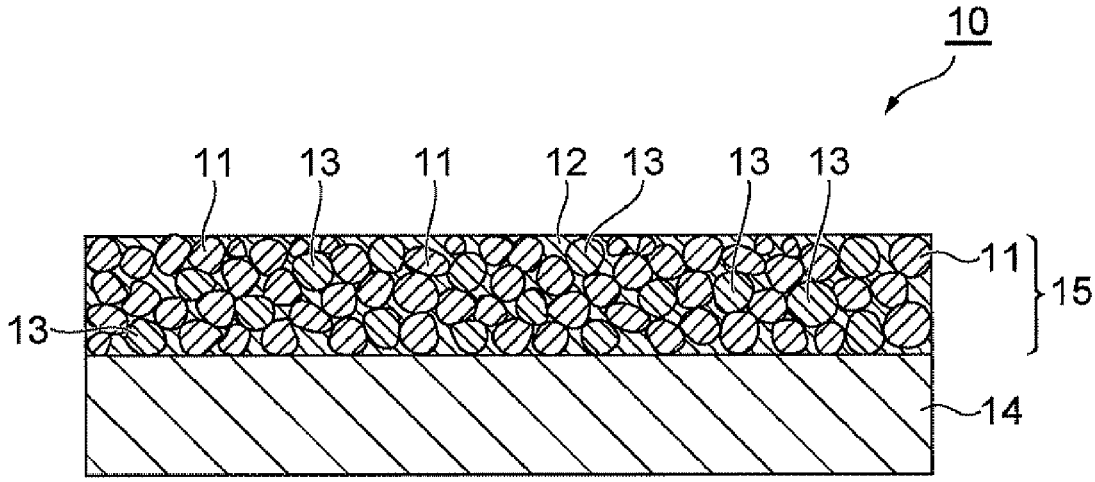
FIG. 1 is a schematic cross-sectional view of a transparent conductive membrane using the transparent conductive material of a preferred embodiment.

Preferred embodiments of the present invention will be described below referring to the Drawings as necessary.

First a transparent conductive material of a preferred embodiment will be described.

The transparent conductive material of the present embodiment comprises a resin; a transparent conductive particle; a silica material comprising at least either of a silica particle or a precursor of a silica particle; and a silane coupling agent.

A resin for the transparent conductive material is a resin material that is curable to form a membrane or a layer and transparent to visible light after curing, and thermosetting resin or a photosetting resin having such properties can be used without limitation. Examples of the resin include an acrylic resin, an epoxy resin and a polystyrene resin. An acrylic resin is especially preferable. As a resin component, a thermoplastic resin, such as a polycarbonate, a polyolefin, a norbornene resin, a fluorocarbon resin, a urethane resin and a polyester, may be contained.

As a transparent conductive particle, a particle composed of a transparent conductive oxide material can be exemplified. Examples of the transparent conductive oxide material include indium oxide; indium oxide doped with at least one element selected from the group consisting of tin, zinc, tellurium, silver, gallium, zirconium, hafnium and magnesium; tin oxide; tin oxide doped with at least one element selected from the group consisting of antimony, zinc and fluorine; zinc oxide; zinc oxide doped with at least one element selected from the group consisting of aluminum, gallium, indium, boron, fluorine and manganese; and titanium oxide doped with niobium or tantalum. Among them an indium tin complex oxide (ITO) that is an indium oxide doped with tin is preferable.

The silica material contains at least either of a silica particle or a precursor of a silica particle. A silica particle means a particle constituted of a material with a chemical composition mainly represented by $SiO_2$. While a precursor of a silica particle means a material that can form the silica particle by heat or irradiation for curing a transparent conductive material in parallel with the curing. Examples of the precursor of a silica particle include a monomer, such as a silanol and a silane, an oligomer and a polymer thereof, a silica sol and a silazane. In case a precursor of a silica particle is used as a silica material, the precursor of a silica particle should be preferably converted to a silica particle during or after the mixture with a transparent conductive particle, in order to regulate the initial resistivity of a transparent conductor (e.g. transparent conductive membrane) to a suitable value. The conversion can be carried out by heating, water addition or catalyst addition. In case the transparent conductive particle is subjected to a compression treatment, the precursor of a silica particle should be preferably converted to the silica particle after the treatment.

As the silane coupling agent, publicly known compounds used as a silane coupling agent may be used, and a specific example includes a compound in which a plurality of alkoxy groups bond to a silicon atom and the remaining bond(s) thereof are occupied by nonhydrolyzable binding organic functional group(s). Preferable examples of a silane coupling agent to be used for the transparent conductive material include, but not limited thereto, vinyltrichlorosilane, vinyltrimethoxysilane, vinyltriethoxysilane, β-(3,4-epoxycyclohexyl)ethyl trimethoxysilane, γ-glycidoxypropyltrimethoxysilane, γ-glycidoxypropyl methyldiethoxysilane, γ-glycidoxypropyltriethoxysilane, p-styryl trimethoxysilane, γ-methacryloxypropylmethyl dimethoxysilane, γ-methacryloxy propyl trimethoxysilane, γ-methacryloxy propylmethyl diethoxysilane, γ-methacryloxy propyl triethoxysilane, γ-acryloxypropyl trimethoxysilane, γ-acryloxypropyl triethoxysilane, γ-methacryloxypropyl dimethylisopropoxysilane, divinyltetramethyldisilazane, N-β-(N-vinylbenzylaminoethyl)-γ-aminopropyltrimethoxysilane hydrochloride, vinyltriacetoxysilane, vinyltris(methoxyethoxy)silane, vinyltriisopropoxysilane, allyltrimethoxysilane, diallyl dimethyl silane, vinylmethyldimethoxysilane, β-(3,4-epoxycyclohexyl)ethyltrimethoxysilane, and γ-glycidoxypropyltriisopropoxysilane. Especially preferable are vinyltrimethoxysilane, vinyltriethoxysilane, and vinyltriisopropoxysilane.

Preferable contents of the respective components of a transparent conductive material are as follows. The content of the silica material (a silica particle or a precursor thereof) is preferably 0.1 to 40% by mass based on the total quantity of the transparent conductive particle and the silica material, and more preferably 1 to 10% by mass. If the content of the silica material is too low, occasionally the suppression effect on the resistance value increase under high temperature and humidity may not be sufficiently obtained. In contrast, although the suppression effect on the resistance increase becomes higher with a higher content of the silica material, the resistance value of a transparent conductive membrane itself obtained by curing tends to become excessively high, because the resistance of the silica particle is generally high. Consequently, in view of realization of a practical resistance value, the upper limit of the content of the silica material is preferably about 40% by mass.

In case the content of the silica particle in the transparent conductive material of the present invention is low, especially in case the content of the silica material is 5% by mass or lower, the resistance value substantially as low as that without addition of the silica material can be obtained despite the presence of the silica material. Consequently, such a content of the silica material is especially preferable for a transparent conductive membrane used for applications requiring low resistance, such as a transparent heater, a touch panel and an electromagnetic shield. However, the content of the silica material is not required to be in this range, if the membrane is directed to an application allowing a higher resistance value of the membrane itself.

The content of the resin is preferably 5 to 50% by mass based on the total quantity of the transparent conductive particle and the silica material, and more preferably 10 to 40% by mass. In case the resin content is too high, the obtained conductivity tends to become insufficient, and in case it is too low, it may be difficult to maintain the form of the transparent conductive layer as described hereinbelow.

The content of the silane coupling agent is, although depending on the specific surface of the silica material, preferably about 0.1 to 80 parts by mass, based on 100 parts of the content of the silica material, and more preferably 5 to 40 parts by mass. In case the content of the silane coupling agent is too low, the bonds between the cured resin and the silica particle or the transparent conductive particle may not be formed sufficiently, so that the suppression effect on the resistance value increase of the transparent conductive membrane may not be sufficiently obtained. Reversely, in case the content of the silane coupling agent is too high, the surface of the conductive particle may be excessively coated and the increase of the resistance value or the adhesion decrease of the resin tends to take place.

The transparent conductive material may contain, in addition to the resin, transparent conductive particle, silica material and silane coupling agent described above, other components as necessary to the extent that the properties as a transparent conductive material be not impaired. Examples of such other components include a metal, a transparent semiconductive particle and a transparent dielectric particle.

Next, a preferred embodiment of the transparent conductor using the aforementioned transparent conductive material will be described below.

FIG. 1 is a schematic cross-sectional view of a transparent conductor using the transparent conductive material of a preferred embodiment. The transparent conductor of the present embodiment is a transparent conductive membrane in a membrane form, and as shown in FIG. 1, the transparent conductive membrane 10 includes a substrate 14 and a transparent conductive layer 15 formed on the substrate 14.

As the substrate 14, any substrate may be applicable without particular restriction insofar as it is composed of a material transparent to visible light. Examples thereof include those composed of a transparent inorganic material such as glass, and those composed of an organic compound such as a plastic material. Examples of the substrate from a plastic material include transparent resin films of a polyester, polyethylene, polypropylene, polyethylene terephthalate (PET), polyethylene naphthalate (PEN), poly-4-methylpentene-1 (TPX), polyvinyl chloride, a polyolefin, an acrylic resin, polystyrene, a polycarbonate, polyvinyl alcohol, a norbornene resin, a polyether sulfone (PES), a polyvinylidene-fluoride (PVDF), polychlorotrifluoroethylene (PCTFE) and a tetrafluoroethylene/hexafluoropropylene/vinylidene fluoride copolymer (THV). Furthermore, a composite material of an inorganic compound and an organic compound (e.g. an organosilicon compound) may be exemplified as a substrate.

A transparent conductive layer 15 is formed of the transparent conductive material of the present invention as described hereinbelow, and stretches little even if the substrate 14 expands and therefore the resistance value hardly increases. Consequently, the substrate 14 forming the transparent conductive layer 15 is preferably composed of an organic material that hardly expands by heat or humidity, so that the advantage of the present invention can be enjoyed.

The transparent conductive layer 15 is a layer composed of a cured body of the transparent conductive material of the present invention. As shown in FIG. 1, the transparent conductive layer 15 is composed mostly of a transparent conductive particle 11 and a silica particle 13, and additionally a cured resin 12 existing in the gaps between the transparent conductive particle 11 and the silica particle 13.

The transparent conductive particle 11, the silica particle 13 and the cured resin 12 in the transparent conductive layer 15 are originated respectively from the transparent conductive particle, the silica particle or the precursor of the silica particle and the resin in the transparent conductive material. Particularly, the silica particle 13 is a silica particle itself in the transparent conductive material or a silica particle converted from a precursor of the silica particle in parallel with curing of the transparent conductive material. The cured resin 12 is formed by curing the resin in the transparent conductive material with heat or a high energy electromagnetic wave such as light and an electron beam.

The particle size of a primary particle of the transparent conductive particle 11 in the transparent conductive layer 15 is preferably 0.005 to 0.5 μm, and more preferably 0.01 to 0.08 μm. In case the particle size of the primary particle of the transparent conductive particle 11 is less than the above range, generation of a conductivity factor of oxygen vacancies tends to become more difficult than that of inside the range and the good conductivity of the transparent conductive layer 15 cannot be obtained stably. In contrast, in case the particle size of the primary particle is too large, the light scattering becomes stronger than that of inside the range and the transparency of the transparent conductive membrane 10 may become poorer. To realize such primary particle size of the transparent conductive particle 11, the transparent conductive particle to be contained in the transparent conductive material should have such primary particle size.

The particle size of a primary particle of the silica particle 13 is preferably 0.005 to 0.5 μm, and more preferably 0.005 to 0.05 μm. In case the particle size of the primary particle of the silica particle is too small, the adhesion of the silica particle 13 to the surface of the transparent conductive particle 11 becomes remarkably large and direct contacts among the transparent conductive particles 11 decrease, which may lead to decrease in the conductivity. In case the particle size is too large, the transparent conductive particles 11 tend to be placed in the gaps among the silica particles 13, so that the contacts between the transparent conductive particles 11 decrease, and the light scattering in the transparent conductive layer 15 increases to decrease the transparency. To make the primary particle size of the silica particle 13 within such range, the silica particle in the transparent conductive material should have such primary particle size or the content of the precursor of the silica particle should be adjusted, so that such primary particle size can be obtained.

The cured resin 12 is placed in the gaps among the transparent conductive particles 11 and the silica particles 13 and functions to bond the particles together. Thereby, although not illustrated, the cured resin 12 and the transparent conductive particle 11 or the silica particle 13 are quasi bonded by a structure derived from a silane coupling agent contained in the transparent conductive material.

It is believed that such bonding is formed by the silane coupling agent bonding to or compatibilizing with the cured resin 12 and further interacting with the transparent conductive particle 11 or the silica particle 13. The interaction of the silane coupling agent with the transparent conductive particle 11 or the silica particle 13 seems to be caused by either or both of a covalent bond formed by a condensation reaction between a silanol group formed by hydrolysis of an alkoxy group of the silane coupling agent, and a hydroxy group having on the surface of the particles, or a hydrogen bond formed between the silanol group and the hydroxy group on the particle surface. Practically, since the structure derived from the silane coupling agent is integrated substantially with the cured resin 12 by bonding and compatibilization, visual confirmation is hardly possible in most cases.

The percentages of the respective components in the transparent conductive layer 15 constituted as above are preferably similar to the percentages of the respective components in the transparent conductive material from which the components are originated. Then, a transparent conductive membrane 10, which is superior in the transparency in the visible region, has little resistance value change under high temperature and humidity, and has sufficiently low resistance of the membrane itself, can be obtained.

Next, a preferred production method of the transparent conductive membrane 10 constituted as above will be described below.

First, a transparent conductive particle and a silica material (a silica particle or a precursor thereof) as described above are prepared respectively, and dispersed in a solvent to obtain a dispersion. Usable examples of the solvent include water, alcohols, such as methanol, ethanol, propanol, isopropanol and butanol, acetone, methyl ethyl ketone, methyl isobutyl ketone and cyclohexanone. For dispersing, a wet-type stirred media mill, a wet-type rotating drum media mill, a dry-type mill, etc., such as a bead mill, a vibrating ball mill and a planetary ball mill may be used.

Then, the dispersion is coated on a substrate made of a PET film, etc. (hereinafter referred to as a "film substrate") and the solvent was removed from the dispersion by evaporation, etc. Thereby a precursor of the transparent conductive layer 15 with dispersed transparent conductive particles and silica material adhere on the film substrate is formed. Examples of an applicable coating method of the dispersion include a reverse roll method, a direct roll method, a blade method, a knife method, an extrusion method, a nozzle method, a curtain method, a gravure roll method, a bar coat method, a dip method, a kiss coat method, a spin coat method, a squeeze method, and a spray method.

Then, another substrate such as a PET film is placed on top of the precursor layer formed on the film substrate, and the whole laminate is pressed to the thickness direction with press rolls, etc., so that the transparent conductive particle and the silica material constituting the precursor layer are coagulated. By such pressing, the resulted contact area among the transparent conductive particles 11 is increased with the effect that the conductivity can be improved. Pressing is dispensable, if a transparent conductive layer 15 with satisfactory properties can be formed without pressing.

After pressing, the substrate is removed from the precursor layer, and then a mixture containing a resin component to form the aforementioned cured resin 12 by curing and a silane coupling agent is coated thereon. Preferably the silane coupling agent is premixed with the resin component. The silane coupling agent may be added as it is, or subjected in advance to a hydrolysis treatment. The hydrolysis of the silane coupling agent can be promoted by addition of an inorganic or organic acid to the mixture of a solvent and the silane coupling agent. Thereby an alkoxy group of a general silane coupling agent is hydrolyzed to form a silanol group. For the hydrolysis of a silane coupling agent, a small amount of water is required. Although such water can be removed later, the removal may compromise the stability of the silanol group and cause gelation. Consequently the water should preferably remain mixed with the resin component. However, when the water is contained, separation of the mixture may occur. Therefore the solvent used for hydrolysis should preferably be water-soluble, so that the separation of the components can be avoided.

The aforementioned mixture of the resin and the silane coupling agent is coated on the surface of the precursor layer composed of the transparent conductive particle and the silica material, and penetrates into the gaps between them. The silanol group of the hydrolyzed silane coupling agent absorbs via a hydrogen bond to a hydroxy group existing on the surfaces of the transparent conductive particle 11 and the silica particle 13 in the precursor layer. Then, by further heating, a dehydration condensation reaction between them proceeds and a covalent bond is formed. It is also conceivable that not all the hydrogen bonds are transferred to covalent bonds, but some of the hydrogen bonds remain intact. Further it is believed that, if the silane coupling agent is added without a hydrolysis pretreatment, hydrolysis proceeds gradually under the influence of environmental moisture or during a heating step and the aforementioned dehydration condensation reaction proceeds with the hydroxy group existing on the surfaces of the transparent conductive particle 11 and the silica particle 13. The resin component and the silane coupling agent may be mixed in advance with the transparent conductive particle 11 and the silica particle 13, and then coated on the film substrate.

Thereafter, to remove the solvent contained in the mixture of the resin and the silane coupling agent, hot air is blasted on the precursor layer. Then the aforementioned substrate 14 is placed tightly on the surface coated with the mixture of the resin and the silane coupling agent, and the laminate is treated with heat or irradiation of light or an electron beam to cure the coated mixture of the resin and the silane coupling agent. For curing the resin, a thermal polymerization initiator in case of thermal curing, or a photo-polymerization initiator in case of photo-curing may be added respectively, so that the curing reaction proceeds further smoothly.

Thereby the layer of the transparent conductive material is cured and the aforementioned transparent conductive layer 15 containing the transparent conductive particle 11, the silica particle 13 and the cured resin 12, as well as bonds originated from the silane coupling agent is constructed. After removing one of the substrates, the transparent conductive membrane 10 having the transparent conductive layer 15 on the remaining substrate 14, structured as described above is obtained.

The transparent conductive material, the transparent conductive membrane and the production method thereof with respect to a preferable embodiment have been described above, however, the present invention is not limited to the embodiment, and appropriately changed embodiments are possible without departing from the spirit of the present invention.

For example, in the above transparent conductive membrane 10, the transparent conductive layer 15 is so structured that the transparent conductive particle 11 or the silica particle 13 and the cured resin 12 are bonded together via the structure originated from the silane coupling agent. However, so far as the transparent conductive layer 15 is composed of the transparent conductive material of the present invention, such bond in the layer is dispensable.

Furthermore, the transparent conductive membrane 10 does not necessarily have the laminate structure in which the transparent conductive layer 15 is laminated on the substrate 14, and may be composed of the transparent conductive layer 15 only, or include any other layer, although not illustrated. For example, a single or plural intermediate layer(s) may be included as necessary between the substrate 14 and the transparent conductive layer 15. There is no particular restriction on materials constituting the intermediate layer, and examples of the intermediate layer include a tie-layer to improve the adhesion between the substrate 14 and the transparent conductive layer 15, an anti-reflection layer to improve the optical property, an inorganic thin film layer to suppress swelling of the substrate 14, and a buffer layer to protect the transparent conductive layer 15 from a stress.

For producing the transparent conductive membrane 10, the transparent conductive particle and the silica material are first coated on the substrate 14 and the resin and the silane coupling agent are allowed to penetrate among them. Alternatively, the respective components may be mixed to obtain a transparent conductive material in advance, and the same may be coated on the substrate 14. Further, the silane coupling agent and the resin may be allowed to penetrate separately.

EXAMPLES

The present invention will now be described in more detail by way of Examples thereof but the present invention is not limited thereto.

Examples 1 to 10, Comparative Examples 1 to 3

As the components of the transparent conductive material, ITO particles for the transparent conductive particle, a silica particle for the silica material, an acrylic resin for the resin, and vinyltrimethoxysilane (KBM1003 from Shin-Etsu Chemical Co., Ltd.) for the silane coupling agent were used respectively to produce according to the following production method transparent conductive membranes of Examples 1 to 10 and Comparative Examples 1 to 3 provided with transparent conductive layers formed from the transparent conductive materials respectively.

The percentage of the silica particle, and the presence or absence of the addition of the silane coupling agent were changed among Examples 1 to 10 and Comparative Examples 1 to 3 respectively as shown in Table 1 below. In Table 1 "No" or "0" (%) means that the relevant component was not used, and in the following production method, a transparent conductive membrane was produced without adding the component. Namely, Comparative Example 1 represents a case, in which the silica particle and the silane coupling agent were not added, Comparative Example 2 represents a case, in which only the silica particle was not added, and Comparative Example 3 represents a case, in which only the silane coupling agent was not added.

(Production of Transparent Conductive Membrane)

For production of a transparent conductive membrane, the ITO particle with the average primary particle size of 26 μm was dispersed in ethanol, to which the silica particle (Aerosil 300 from Nippon Aerosil Co., Ltd.) was added, and the mixture was treated for dispersion by a bead mill (UAM015 from Kotobuki Industries Co., Ltd.) for 20 min to prepare a dispersion. Here, total 100 g of the ITO particle and the silica particle were used, and the silica particle was adjusted to the content (%) shown in Table 1 relative to such total amount.

Next, the obtained dispersion was coated by a bar coater (a custom-made wire bar coater by SMT Co., Ltd.) on a PET film to the coat thickness of 1.7 μm after removal of ethanol, followed by removal of ethanol from the coated dispersion by heating with hot air of 80° C. Then, another PET film was placed on the precursor layer obtained by drying the coated liquid, and the whole laminate was compressed by press rolls to obtain a precursor layer with the coagulated ITO particle and silica particle. The thickness of the precursor layer was 1.0 μm.

One of the PET films was removed from the compressed precursor layer, to which the mixture liquid obtained by mixing the following components was coated by a bar coat method, followed by evaporation of methyl ethyl ketone from the precursor layer coated with the mixture liquid by hot air of 80° C.

(Composition of Mixture Liquid)

poly(methyl methacrylate) (weight average molecular weight Mw=500,000): 50 parts by mass ethoxylated glycerin triacrylate (multifunctional compound, A-GLY-20E from Shin-Nakamura Chemical Co., Ltd.): 20 parts by mass polyethylene glycol dimethacrylate (multifunctional compound, 14G from Shin-Nakamura Chemical Co., Ltd.): 20 parts by mass trimethylolpropane triacrylate (multifunctional compound, TMPT from Shin-Nakamura Chemical Co., Ltd.): 10 parts by mass photo-polymerization initiator (ESACURE ONE from Lamberti S.p.A.): 2 parts by mass methyl ethyl ketone (MEK from Kanto Chemical Co., Inc.): 200 parts by mass vinyltrimethoxysilane (silane coupling agent, KBM1003 from Shin-Etsu Chemical Co., Ltd.): 2% by weight of the total solid content in the mixture liquid.

Then, a 200 μm-thick PET film was laminated to the precursor layer surface after impregnation of the mixture liquid and irradiated by UV rays to cure the acrylic resins. Then, the PET film on which the precursor layer was formed was removed to obtain a transparent conductive membrane composed of the transparent conductive layer provided on the substrate of the 200 μm-thick PET film. At the time, as the source of the UV rays a metal halide lamp was used to irradiate the light in the wave length range of 320 nm to 390 nm at the irradiance of 3.0 W/cm$^2$ to the fluence of 2.0 J/cm$^2$.

(Measurement of Resistance Value and Resistance Value Change Rate)

First, the resistance value (Ω/□) of the transparent conductive membrane obtained by each of Examples 1 to 10 and Comparative Examples 1 to 3 was measured by a 4-terminal method. Next, the respective transparent conductive membranes were left in an environmental test chamber (60° C., 95% RH) for 750 hours for weathering. Then the resistance value of each transparent conductive membrane after weathering was measured similarly. From the obtained results the change rates of the resistance value after weathering of the respective transparent conductive membranes relative to the reference resistance values before weathering (resistance value after weathering/resistance value before weathering) were calculated and defined as the resistance value change rates.

Figure 2:
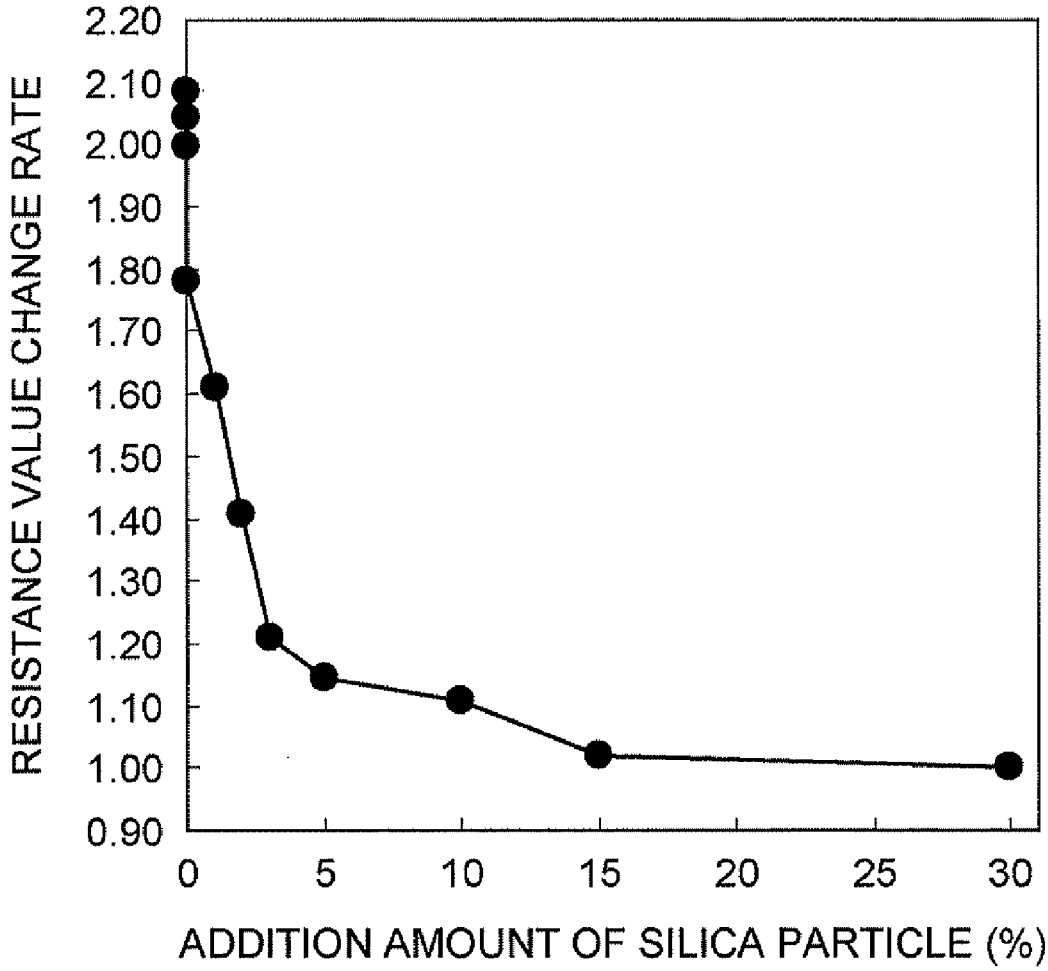
FIG. 2 is a graph plotting the values of the resistance value change rates vs. the content of the silica particle.

The obtained results are shown in Table 1 and FIG. 2. In Table 1, "0 h" in the column of resistance value means the resistance value before weathering and "750 h" means the resistance value after weathering. FIG. 2 is a graph plotting the values of the resistance value change rates vs. the content of the silica particle, obtained for Comparative Example 2 and Examples 1 to 10, in which the silane coupling agent was added.

TABLE 1

| | Addition of silane coupling agent | Addition amount of silica particle (%) | Resistance value (Ω/□) 0 h | 750 h | Resistance value change rate |
|---|---|---|---|---|---|
| Comparative Example 1 | No | 0 | 462.3 | 44680 | 96.65 |
| Comparative Example 2 | Yes | 0 | 466.2 | 972 | 2.08 |
| Comparative Example 3 | No | 0.05 | 475.6 | 38420 | 80.78 |
| Example 1 | Yes | 0.005 | 467.6 | 956 | 2.04 |
| Example 2 | Yes | 0.01 | 468.9 | 936.4 | 2.00 |
| Example 3 | Yes | 0.05 | 473.1 | 843.2 | 1.78 |
| Example 4 | Yes | 1 | 475.5 | 766.1 | 1.61 |
| Example 5 | Yes | 2 | 499 | 701.1 | 1.41 |
| Example 6 | Yes | 3 | 552.6 | 668.2 | 1.21 |
| Example 7 | Yes | 5 | 674.4 | 772.6 | 1.15 |
| Example 8 | Yes | 10 | 4410 | 4880 | 1.11 |
| Example 9 | Yes | 15 | 29800 | 30400 | 1.02 |
| Example 10 | Yes | 30 | 74900 | 75100 | 1.00 |

As shown in Table 1 and FIG. 2, it is confirmed that the resistance value change rate through weathering is small and the resistance increase under high humidity is little with the transparent conductive membranes of Examples 1 to 10 in comparison to Comparative Examples 1 to 3 in which the transparent conductive materials without either or both of a silica particle and a silane coupling agent were used. Especially it is also confirmed, that in case the addition amount of the silica particle is relatively low (Examples 1 to 7), the resistance value of the transparent conductive membrane itself is also low enough.

What is claimed is:

1. A transparent conductive material, comprising:

a resin;

a transparent conductive particle;

a silica material comprising at least either of a silica particle or a precursor of a silica particle, wherein a content of the silica material is 0.1 to 40% by mass relative to the total quantity of the transparent conductive particle and the silica material; and a silane coupling agent.

2. A transparent conductor having a transparent conductive layer comprising a cured body of the transparent conductive material according to claim 1.

3. The transparent conductor according to claim 2, comprising a substrate containing an organic compound and the transparent conductive layer provided on the substrate.

* * * * *